US005452653A

United States Patent [19]

Gaj et al.

[11] Patent Number: 5,452,653

[45] Date of Patent: Sep. 26, 1995

[54] BAND INSERTER

[76] Inventors: Theodore S. Gaj, 19 Reed Ave., Chicopee, Mass. 01020; George Spector, 233 Broadway Rm. 702, New York, N.Y. 10279

[21] Appl. No.: 303,741

[22] Filed: Sep. 9, 1994

[51] Int. Cl.[6] ..... B65B 13/04

[52] U.S. Cl. ..... 100/24; 53/592; 139/448; 294/191

[58] Field of Search ..... 53/589, 592, 389.2; 100/1, 24; 139/448; 294/19.1; 81/155, 157, 164

[56] References Cited

U.S. PATENT DOCUMENTS 1,361,050 12/1920 Hahn ..... 81/164
2,853,000 9/1958 Russell ..... 100/24
3,873,143 3/1975 Foust ..... 294/19.1
4,119,023 10/1978 Boe et al. ..... 100/24

*Primary Examiner*—John Sipos
*Assistant Examiner*—Gene L. Kim

[57] ABSTRACT

A band inserter device comprising a housing having a forward transverse slot therethrough and a rearward internally threaded aperture, whereby the slot is to receive an end of a banding strap. An elongated handle having an externally threaded shank engages with the internally threaded aperture. An assembly within the housing is for gripping the end of the banding strap when the shank of the handle is tightened in the aperture of the housing, so that the banding strap can be inserted under a skid and about a package on the skid.

3 Claims, 1 Drawing Sheet

BAND INSERTER

BACKGROUND OF THE INVENTION

The instant invention relates generally to packaging appliances and more specifically it relates to a band inserter device, which provides a mechanism to grip a banding strap and insert it under a skid.

There are available various conventional packaging appliances which do not provide the novel improvements of the invention herein disclosed.

SUMMARY OF THE INVENTION

A primary object of the present invention is to provide a band inserter device that will overcome the shortcomings of the prior art devices.

Another object is to provide a band inserter device that will grip a banding strap without damaging it, whereby it can be inserted under a skid.

An additional object is to provide a band inserter device that will cut banding time in half and will save on back bending and knee problems.

A further object is to provide a band inserter device that is simple and easy to use.

A still further object is to provide a band inserter device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
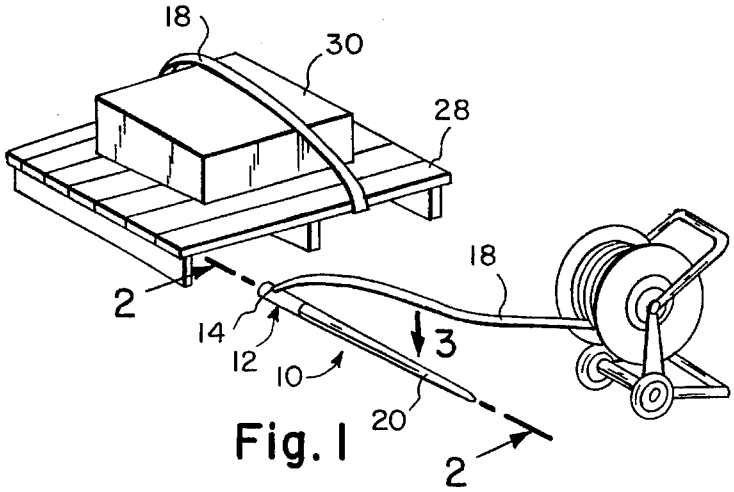
FIG. 1 is a perspective view of a first embodiment of the instant invention in use.

Turning now descriptively to the drawings, in which similar reference characters denote similar elements throughout the several views, FIGS. 1 through 7 illustrate a band inserter device 10 comprising a housing 12 having a forward transverse slot 14 therethrough and a rearward internally threaded aperture 16, whereby the slot 14 is to receive an end of a banding strap 18. An elongated handle 20 having an externally threaded shank 22 engages with the internally threaded aperture 16. An assembly 24 within the housing 12, is for gripping the end of the banding strap 18 when the shank 22 of the handle 20 is tightened in the aperture 16 of the housing 12, so that the banding strap 18 can be inserted under a skid 28 and about a package 30 on the skid 28.

Figure 2:
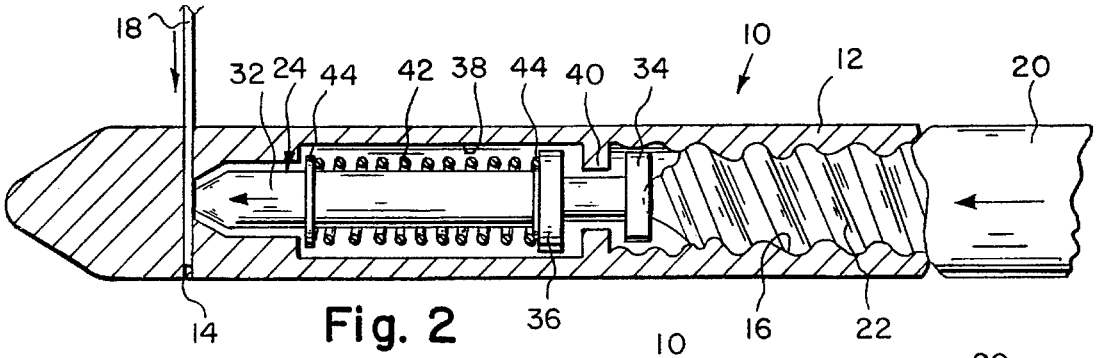
FIG. 2 is an enlarged cross sectional view taken along line 2—2 in FIG. 1.
Figure 3:
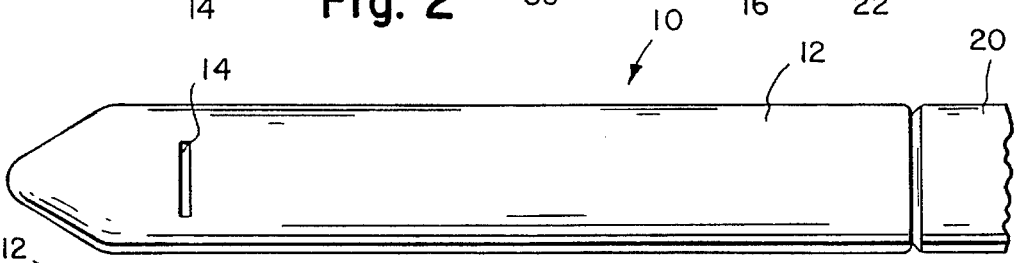
FIG. 3 is an enlarged top view taken in the direction of arrow 3 in FIG. 1.
Figure 4:
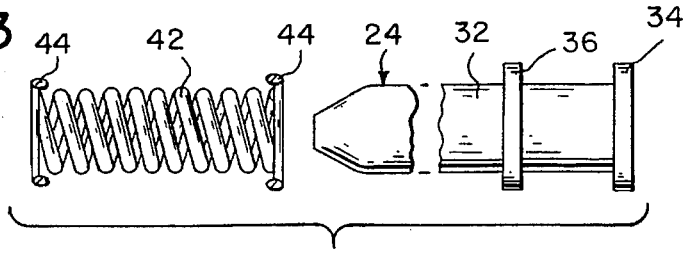
FIG. 4 is a partly exploded side view with parts broken away and in section of the internal components in FIG. 2.

The gripping assembly 24, as shown in FIGS. 2 and 4, includes a plunger 32 having a pair of flanges 34 and 36. The first flange 34 is on a rear end of the plunger 32, while the second flange 36 is spaced away from the first flange 34. The housing 12 has a bore 38 between the transverse slot 14 and the internally threaded aperture 16, with an annular stop member 40 positioned between the pair of flanges 34 and 36 on the plunger 32 in the bore 38.

A spring 42 is on a forward portion of the plunger 32 in front of the second flange 36. A pair of washers 44 are also provided, with each located on an opposite end of the spring 42 on the plunger 32. The spring 42 will normally bias the plunger 32 away from the slot 14, until the handle 20 is tightened to cause the shank 22 to force the plunger 32 forward into the slot 14 to hold the end of the banding strap 18 therein.

Figure 5:
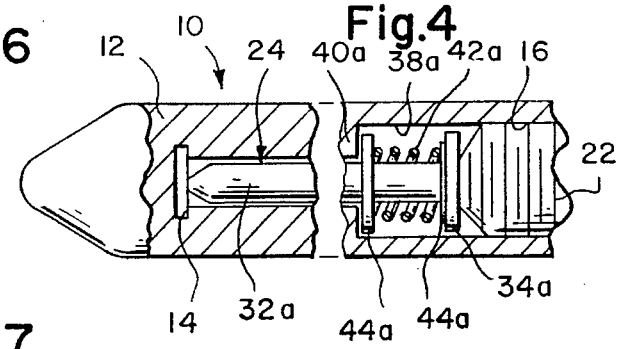
FIG. 5 is an enlarged top view with parts broken away and in section of a second embodiment of the instant invention.

The gripping assembly 24 in FIG. 5, consists of a plunger **32*a* having a flange 34*a* on a rear end thereof. The housing 12 has a bore 38*a* between the transverse slot 14 and the internally threaded aperture 16, with an annular stop member 40*a* spaced away from the flange 34*a*. A spring 42*a* is on a rearward portion of the plunger 32*a* in front of the flange 34*a***.

A pair of washers **44*a* are also provided, with each located on an opposite end of the spring 42*a* on the plunger 32*a*. The spring 42*a* will normally bias the plunger 32*a* away from the slot 14, until the handle 20 is tightened to cause the shank 22 to force the plunger 32*a* forward into the slot 14, to hold the end of the banding strap 18** therein.

Figure 6:
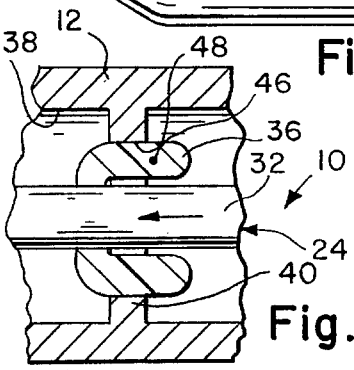
FIG. 6 is an enlarged cross sectional view of a portion of a third embodiment of the instant invention, showing a flexible annular flange on the plunger being inserted through an aperture in the stop member.
Figure 7:
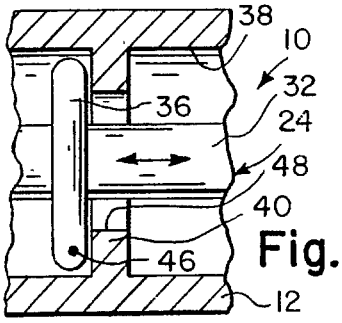
FIG. 7 is an enlarged cross sectional view similar to FIG. 6, showing the flexible annular flange on the plunger completely inserted through the aperture in the stop member.

As shown in FIGS. 6 and 7, the second flange 36 can be fabricated out of a flexible material 46, so that the second flange **36*a* can be inserted through an aperture 48 in the stop member 40, to allow the plunger 32 to be in its proper spring biased position within the bore 38 of the housing 12**.

OPERATION OF THE INVENTION

To use the band inserter device 10, a person simply inserts the end of the banding strip 18 into the transverse slot 14 in the housing 12. The handle 20 is then tightened, so that the plunger 32, **32*a* will move forward to hold the end of the banding strap 18 therein. The banding strap 18 can now be inserted under the skid 28 and about the package 30 on the skid 18, as shown in FIG. 1**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A band inserter device comprising:

a) a housing having a forward transverse slot therethrough and a rearward internally threaded aperture, whereby said slot is to receive an end of a banding strap;

b) an elongated handle having an externally threaded shank to engage with said internally threaded aperture;

for moving said shank axially forward when said handle is rotated to tighten and retain said band in said slot;

c) gripping means within said housing, responsive to tightening rotation of said handle to move said shank forward thereby moving said gripping means forward to grip and retain said band in said slot so that the banding strap can be inserted under a skid and about a package on the skid; wherein said gripping means includes:

d) a plunger having a pair of flanges in which said first flange is on a rear end of said plunger, while said second flange is spaced away from said first flange;

e) said housing having a bore between said transverse slot and said internally threaded aperture, with an annular stop member, with an aperture therethrough positioned between said pair of flanges on said plunger in said bore;

f) a spring on a forward portion of said plunger in front of said second flange and g) a pair of washers, each located on an opposite end of said spring on said plunger, so that said spring will normally bias said plunger away from said slot, until said handle is rotated to tighten said shank to move said plunger forward into said slot to grip and hold the end of said banding strap therein.

2. A band inserter device as recited in claim 1, wherein said gripping means includes:

a) a plunger having a flange on a rear end thereof;

b) said housing having a bore between said transverse slot and said internally threaded aperture, with an annular stop member spaced away from said flange;

c) a spring on a rearward portion of said plunger in front of said flange and d) a pair of washers, each located on an opposite end of said spring on said plunger, so that said spring will normally bias said plunger away from said slot, until said handle is rotated to tighten to cause said shank to move said plunger forward into said slot to hold the end of said banding strap therein.

3. A band inserter device as recited in claim 1, wherein said second flange is fabricated out of a flexible material so that said second flange can be inserted through said aperture in said stop member to allow said plunger to be in its proper spring biased position within said bore of said housing.

* * * * *